US006020678A

United States Patent [19]

Maehara

[11] Patent Number: 6,020,678

[45] Date of Patent: Feb. 1, 2000

[54] COLOR CATHODE-RAY TUBE HAVING INTERNAL MAGNETIC SHIELD

[75] Inventor: Mutsumi Maehara, Mobara, Japan

[73] Assignee: Hitachi, Ltd., Tokyo, Japan

[21] Appl. No.: 08/950,663

[22] Filed: Oct. 15, 1997

[30] Foreign Application Priority Data

Oct. 18, 1996 [JP] Japan ..... 8-276244

[51] Int. Cl.[7] ..... H01J 29/06

[52] U.S. Cl. ..... 313/402; 313/407; 313/479

[58] Field of Search ..... 313/402, 479, 313/407; 315/8, 85; 174/35 R, 35 MS

[56] References Cited

FOREIGN PATENT DOCUMENTS 2-220334 9/1990 Japan .

OTHER PUBLICATIONS

H. Yoshida et al., High Resolution Color Display Tubes for Display Terminals, Hitachi Review vol. 32, No. 1, pp. 33–36, 1983 (no month).

*Primary Examiner*—Michael H. Day
*Attorney, Agent, or Firm*—Antonelli, Terry, Stout & Kraus, LLP

[57] ABSTRACT

A color cathode-ray tube including a panel portion, a neck portion and a funnel portion connecting these two portions and having an internal magnetic shield, wherein the internal magnetic shield is disposed in the funnel portion and made of a substantially quadrangular pyramid-shaped frame structure which has a substantially rectangular first opening of small diameter at one end adjacent to an electron gun and a substantially rectangular second opening of large diameter at the other end adjacent to a shadow mask and creased lines formed between corresponding corners of the first and second openings, side faces of the internal magnetic shield opposite to each other being formed with substantially V-shaped notches respectively in the portions thereof adjacent to the first opening, and each of the creased lines of the internal magnetic shield is formed in such a manner that an end of an imaginary line extension of the creased line adjacent to the second opening is located on a projected plane parallel to the second opening at a point shifted by a predetermined length from the corresponding corner of the second opening in the direction of side of the second opening and a segment is made by connecting a predetermined point on a line connecting between the end of the imaginary line extension and the corresponding corner of the first opening to the corresponding corner of the second opening so as to form a part of the creased line adjacent to the second opening.

9 Claims, 5 Drawing Sheets

COLOR CATHODE-RAY TUBE HAVING INTERNAL MAGNETIC SHIELD

FIELD OF THE INVENTION

This invention relates to a color cathode-ray tube having an internal magnetic shield, and more specifically to a color cathode-ray tube having an internal magnetic shield which is so constructed that an electron beam is less affected by external magnetic field such as terrestrial magnetism from the time it is emitted from an electron gun to the time it strikes a fluorescent layer through a shadow mask so as to provide a display image of high color purity.

DESCRIPTION OF THE RELATED ART

A color cathode-ray tube generally has an evacuated glass envelope (bulb) comprising a panel portion located at the front and having a face plate of large diameter, a neck portion of small diameter located at the rear, and a substantially funnel-shaped funnel portion connecting the panel portion and the neck portion. In the panel portion, a fluorescent layer is formed on an inner surface of the face plate by coating, and a shadow mask having a large number of electron beam apertures is placed opposite to the fluorescent layer. The neck portion houses an electron gun which emits three electron beams. In the funnel portion, an internal magnetic shield made of a substantially quadrangular pyramid-shaped frame structure is disposed inside the color cathode-ray tube, while a deflection coil is disposed outside the same tube.

In this case, the internal magnetic shield is disposed for the purpose that three electron beams emitted from the electron gun are prevented from being affected by terrestrial magnetism. If the internal magnetic shield does not have a sufficient effect of shielding terrestrial magnetism, the three electron beams are affected by terrestrial magnetism to be caused to slightly deviate from the original electron beam path, with the result that the display image of the color cathode-ray tube is deteriorated in color purity and suffered from color contamination.

FIGS. 5A to 5C show an example of construction of a conventional internal magnetic shield used in a known color cathode-ray tube, and FIG. 5A is a perspective view, FIG. 5B is a top view and FIG. 5C is a side view.

As shown in FIGS. 5A to 5C, a known internal magnetic shield is made of a substantially quadrangular pyramid-shaped frame member 40 made up of two long side walls 41A, 41B and two short side walls 42A, 42B. The internal magnetic shield has a substantially rectangular first opening 43 of small diameter at one end adjacent to an electron gun and a substantially rectangular second opening 44 of large diameter at the other end adjacent to a shadow mask. The two long side walls 41A, 41B are formed in the portions thereof adjacent to the first opening 43 with substantially V-shaped notches 43A, 43B having a maximum depth c', respectively.

When the frame member 40 is disposed inside the funnel portion, an edge portion 45 of the second opening 44 is fitted to a support frame mounted on the side wall of the panel portion together with the peripheral portion of the shadow mask. In this case, the substantially rectangular first opening 43 of small diameter faces an electron gun and the substantially rectangular second opening 44 of large diameter faces the shadow mask so as to allow three electron beams emitted from the electron gun to pass through the inside of the frame member 40 and strike a fluorescent layer through one of electron beam apertures of the shadow mask.

In the meantime, the substantially V-shaped notches 43A, 43B formed in the two long side walls 41A, 41B are provided for regulating the path for the electron beam passing through the inside of the frame member 40. By selecting the maximum depth c' of the substantially V-shaped notches 43A, 43B, the amount of terrestrial magnetism converging on the two long side walls 41A, 41B and the two short side walls 42A, 42B is controlled. Incidentally, the substantially V-shaped notches 43A, 43B may be formed in the two short side walls 42A, 42B instead of being formed in the two long side walls 41A, 41B, in which case the same performance can be attained as well.

In such internal magnetic shield, however, if the maximum depth c' of the substantially V-shaped notches 43A, 43B is increased for the purpose of appropriate regulation of the electron beam path, although the electron beam path can be regulated, there arises a problem that the effective area of the two long side walls 41A, 41B or the two short side walls 42A, 42B is reduced correspondingly to an increment of depth of the substantially V-shaped notches 43A, 43B, resulting in deterioration of the total shielding effect of the internal magnetic shield.

The present invention aims to solve the above problem. It is an object of the present invention to provide a color cathode-ray tube having an internal magnetic shield which is capable of appropriately regulating an electron beam path even if the maximum depth of a substantially V-shaped notch is made small lest a total shielding effect should be deteriorated.

SUMMARY OF THE INVENTION

To achieve the above object, there is provided according to the present invention a color cathode-ray tube having an internal magnetic shield, which comprises at least a fluorescent layer formed on an inner surface of a face plate of a panel portion, a shadow mask disposed opposite to the fluorescent layer, an electron gun housed in a neck portion, and the internal magnetic shield disposed in a funnel portion and made of a substantially quadrangular pyramid-shaped frame member which has a substantially rectangular first opening of small diameter at one end adjacent to the electron gun and a substantially rectangular second opening of large diameter at the other end adjacent to the shadow mask, and creased lines formed between corresponding corners of the first and second openings, wherein each of the creased lines of the internal magnetic shield is formed in such a manner that an end of an imaginary line extension of the creased line adjacent to the second opening is located on a projected plane parallel to the second opening at a point shifted by a predetermined length from the corresponding corner of the second opening in the direction of side of the second opening, and a segment is made by connecting a predetermined point on a line connecting between the end of the imaginary line extension and the corresponding corner of the first opening to the corresponding corner of the second opening so as to form a part of the creased line adjacent to the second opening, thereby adjusting the area ratio of side faces of the internal magnetic shield.

Preferably, the ends of the imaginary line extensions of the creased lines adjacent to the substantially rectangular second opening are located on the projected plane at the points shifted by a predetermined length from the corners in the direction of long side when the fluorescent layer is made of a large number of phosphor dots.

It is also preferred that the ends of the imaginary line extensions of the creased lines adjacent to the substantially rectangular second opening are located on the projected plane at the points shifted by a predetermined length from the corners in the direction of short side when the fluorescent layer is made of a large number of phosphor stripes.

According to the present invention, the ends of the imaginary line extensions of the creased lines adjacent to the second opening are located at the points shifted by a predetermined length from the corners in the direction of side for the purpose that the ratio of the effective area of the two long side walls to the effective area of the two short side walls is adjusted by selecting the predetermined length instead of the known means of adjusting the maximum depth of the substantially V-shaped notches formed in the two long side walls or two short side walls, and accordingly, even if the maximum depth of the substantially V-shaped notches is so selected as to become small, it is possible to appropriately regulate the electron beam path, and moreover the total shielding effect is not deteriorated.

In the present invention, the ends of the imaginary line extensions of the creased lines adjacent to the second opening are the points located on the sides of the second opening on the projection plane when the internal magnetic shield is projected on a plane parallel to the opening of the magnetic shield.

BRIEF DESCRIPTION OF THE DRAWINGS

FIGS. 2A to 2C show the structure of the first embodiment of the internal magnetic shield used in the color cathode-ray tube of FIG. 1 in which substantially V-shaped notches are formed in long side walls and, in which FIG. 2A is a perspective view, FIG. 2B is a top view and FIG. 2C is a side view, FIG. 2B being equivalent to a view projected on a plane parallel to an opening of the internal magnetic shield;

DESCRIPTION OF THE PREFERRED EMBODIMENTS

Now, embodiments of the present invention will be described with reference to the drawings.

Figure 1:
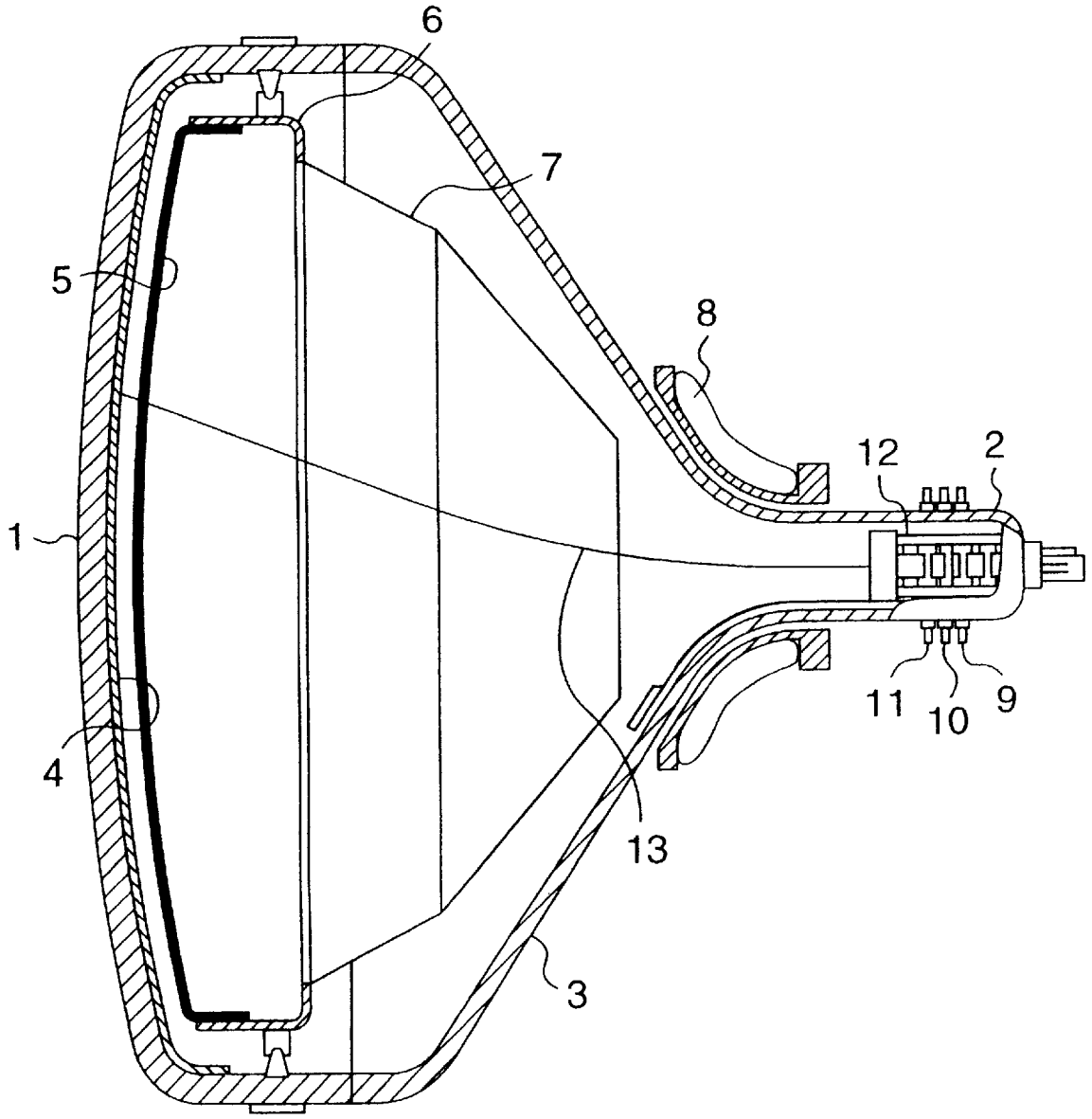
FIG. 1 is a sectional view showing a schematic structure of a color cathode-ray tube having an internal magnetic shield according to a first embodiment of the present invention.

FIG. 1 is a sectional view showing a schematic structure of a color cathode-ray tube having an internal magnetic shield according to a first embodiment of the present invention.

In FIG. 1, reference numeral 1 denotes a panel portion; 2, a neck portion; 3, a funnel portion; 4, a fluorescent layer; 5, shadow mask; 6, a support frame; 7, an internal magnetic shield; 8, a deflection yoke; 9, a purity magnet; 10, a center beam static convergence adjustment magnet; 11, a side beam static convergence adjustment magnet; 12, an electron gun; and 13, an electron beam.

An evacuated glass envelope (bulb) constituting the color cathode-ray tube comprises the panel portion 1 located at the front and having the fluorescent layer 4 formed on the inner surface of a face plate, the long and slender neck portion 2 located at the rear and housing the electron gun 12, and the substantially funnel-shaped funnel portion 3 connecting the panel portion 1 and the neck portion 2. The shadow mask 5 is attached at the peripheral edge thereof to the support frame 6 mounted on the side wall of the panel portion 1 so as to be disposed and fixed in such a condition that it faces the fluorescent layer 4. The substantially quadrangular pyramid-shaped internal magnetic shield 7 is mounted at the edge portion thereof on the support frame 6 so that it is disposed inside the evacuated envelope so as to extend from the panel portion 1 to the funnel portion 3. The deflection yoke 8 is attached to the outside of the evacuated envelope so as to be located at the connecting portion of the funnel portion 3 and the neck portion 2. The purity magnet 9, center beam static convergence adjustment magnet 10, and side beam static convergence adjustment magnet 11 are all placed about the neck portion 2 in side-by-side relation. Three electron beams 13 emitted from the electron gun 12 (only one of them being shown in FIG. 1) are deflected in a predetermined direction by the magnetic field produced by the deflection yoke 8 and then allowed to reach corresponding one of color pixels on the fluorescent layer 4 through one of a large number of electron beam apertures (not shown) formed in the shadow mask 5.

Operation of the color cathode-ray tube having the above construction, that is, image displaying operation is quite the same as that of the known color cathode-ray tube, and therefore description of the image displaying operation of this color cathode-ray tube is omitted.

Figure 2A:
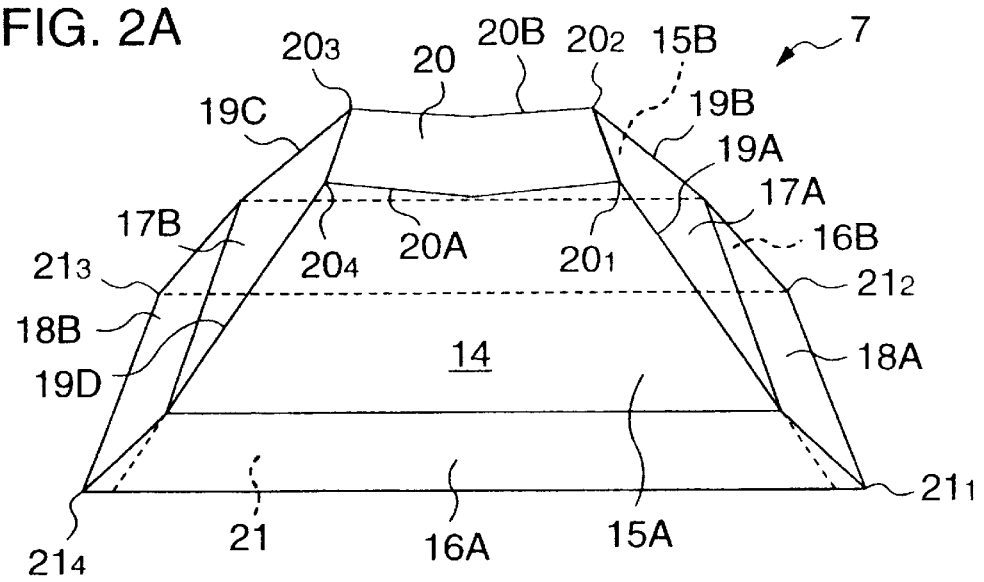
Figure 2B:
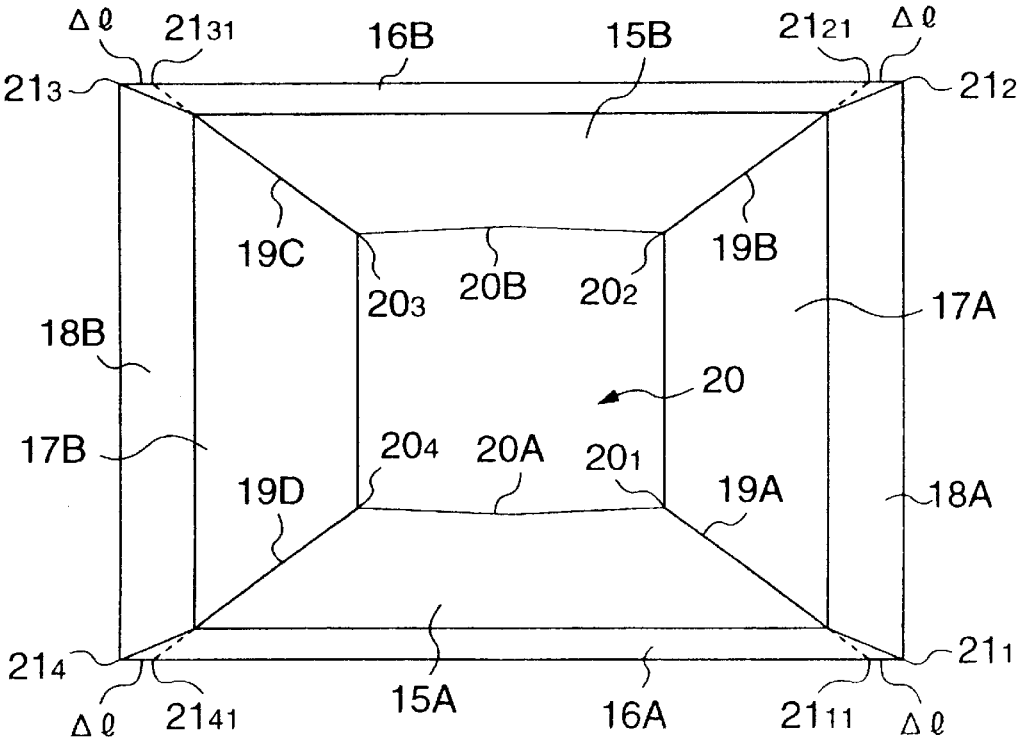
Figure 2C:
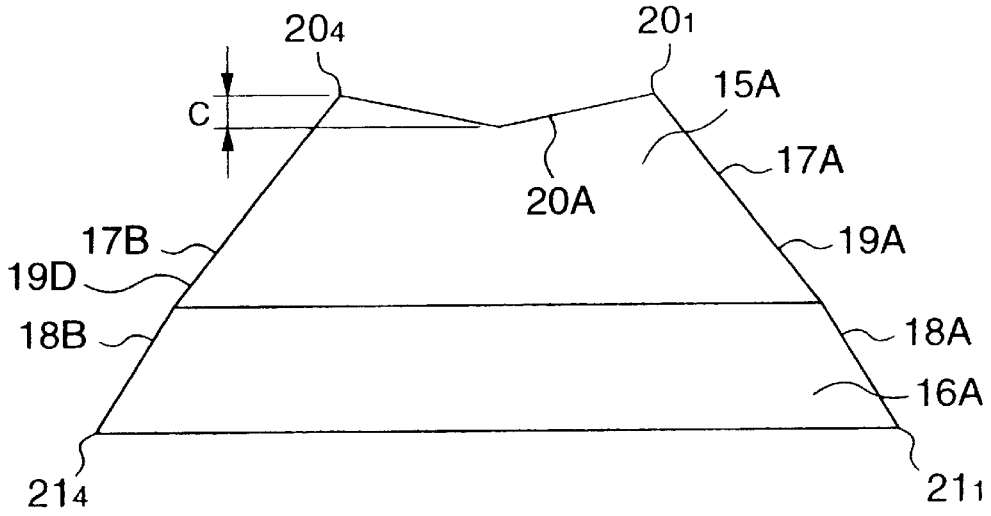

FIGS. 2A to 2C show the structure of a first embodiment of the internal magnetic shield 7 used in the color cathode-ray tube of the present invention shown in FIG. 1. FIG. 2A is a perspective view, FIG. 2B is a top view and FIG. 2C is a side view. It is noted that FIG. 2B is equivalent to a view projected on a plane parallel to an opening of the magnetic shield.

As shown in FIGS. 2A to 2C, the internal magnetic shield 7 of this embodiment is made of a substantially quadrangular pyramid-shaped frame structure 14 comprising two long side walls 15A, 15B, narrow size adjustment side walls 16A, 16B connected respectively to the lower portions of the two side walls 15A, 15B, two short side walls 17A, 17B, narrow size adjustment side walls 18A, 18B connected respectively to the lower portions of the two side walls 17A, 17B, a creased line 19A formed between the side walls 15A and 17A, a creased line 19B formed between the side walls 17A and 15B, a creased line 19C formed between the side walls 15B and 17B, and a creased line 19D formed between the side walls 17B and 15A. The frame structure 14 has a substantially rectangular first opening 20 of small diameter at one end adjacent to the electron gun 12 and a substantially rectangular second opening 21 of large diameter at the other end adjacent to the shadow mask 5. The two long side walls 15A, 15B are formed in the portions thereof adjacent to the first opening 20 with substantially V-shaped notches 20A, 20B having a maximum depth c, respectively.

As shown in FIG. 2B, the creased line 19A is formed in such a manner that one end adjacent to the first opening 20 coincides with a first corner $\mathbf{20}_1$ of the first opening 20 and the other end which is an imaginary line extension thereof is adjacent to the second opening 21 and does not coincide with a first corner $\mathbf{21}_1$ of the second opening 21 but is located on a projected plane parallel to the second opening 21 at a point $\mathbf{21}_{11}$ shifted by a predetermined length $\Delta l$ from the first corner $\mathbf{21}_1$ in the direction of long side. Similarly, the creased line 19B is formed in such a manner that one end adjacent to the first opening 20 coincide with a second corner $\mathbf{20}_2$ of the first opening 20 and the other end which is an imaginary line extension thereof is adjacent to the second opening 21 and does not coincide with a second corner $\mathbf{21}_2$ of the second opening 21 but is located at a point $\mathbf{21}_{21}$ shifted by the predetermined length Δl from the second corner $\mathbf{21}_2$ in the direction of long side. The creased line 19C is formed in such a manner that one end adjacent to the first opening 20 coincides with a third corner $\mathbf{20}_3$ of the first opening 20 and the other end which is an imaginary line extension thereof is adjacent to the second opening 21 and does not coincide with a third corner $\mathbf{21}_3$ of the second opening 21 but is located at a point $\mathbf{21}_{31}$ shifted by the predetermined length Δl from the third corner $\mathbf{21}_3$ in the direction of long side. The creased line 19D is formed in such a manner that one end adjacent to the first opening 20 coincides with a fourth corner $\mathbf{20}_4$ of the first opening 20 and the other end which is an imaginary line extension thereof is adjacent to the second opening 21 and does not coincide with a fourth corner $\mathbf{21}_4$ of the second opening 21 but is located at a point $\mathbf{21}_{41}$ shifted by the predetermined length Δl from the fourth corner $\mathbf{21}_4$ in the direction of long side.

The size adjustment side walls 16A, 16B and 18A, 18B are auxiliary members provided for making the ends of the imaginary line extension of the creased lines 19A, 19B, 19C, 19D adjacent to the second opening 21 approximately coincide with their respective physical ends, that is, the corners of the second opening 21, because the ends of the imaginary line extensions do not coincide with the corners of the second opening 21. In this case, the size adjustment side walls 16A, 16B are so shaped that the creased lines 19A, 19B, 19C, 19D are bent outward at their respective points close to the second opening 21 in three dimensions so as to make the physical ends of the creased lines 19A, 19B, 19C, 19D coincide with the corresponding corners of the second opening 21, respectively. Meanwhile, the size adjustment side walls 18A, 18B are so shaped that, in conformity with the fact that the creased lines 19A, 19B, 19C 19D are bent outward at their respective points close to the second opening 21, the surfaces of the two short side walls 17A, 17B are bent outward in the same manner so as to make the physical ends of the creased lines 19A, 19B, 19C, 19D coincide with the corresponding corners $\mathbf{21}_1$, $\mathbf{21}_2$, $\mathbf{21}_3$, $\mathbf{21}_4$ of the second opening 21, respectively.

Figure 5A:
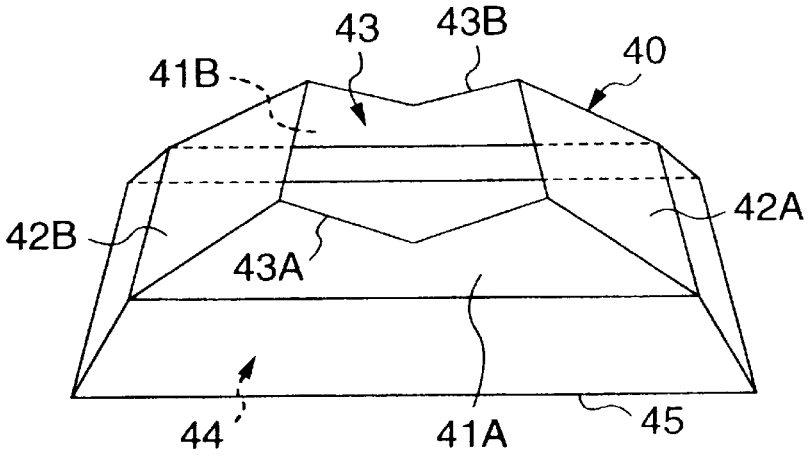
FIG. 5A (PRIOR ART)
FIGS. 5A to 5C show an example of internal magnetic shield used in a known color cathode-ray tube.
Figure 5B:
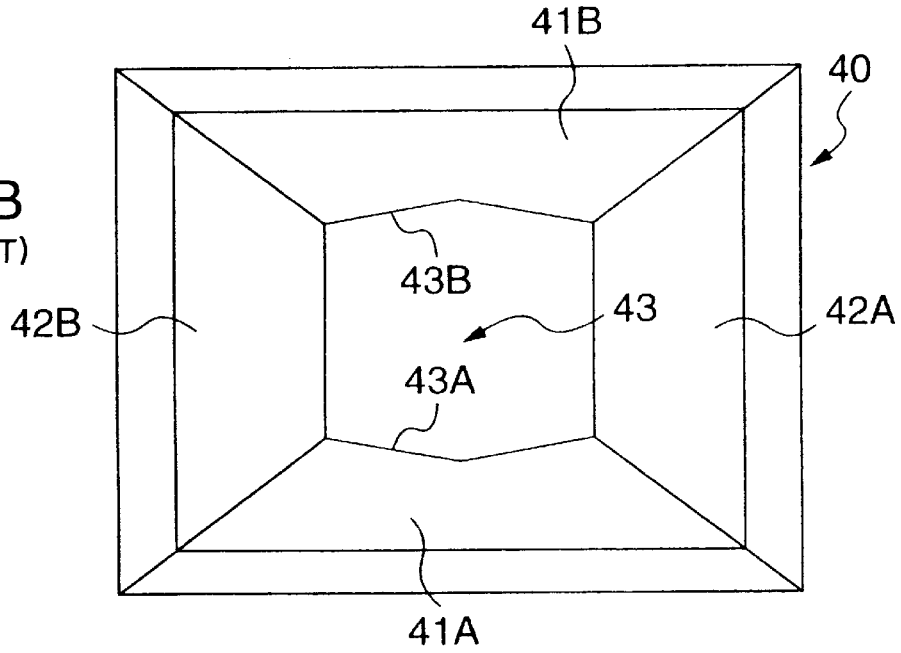
FIG. 5B (PRIOR ART)
Figure 5C:
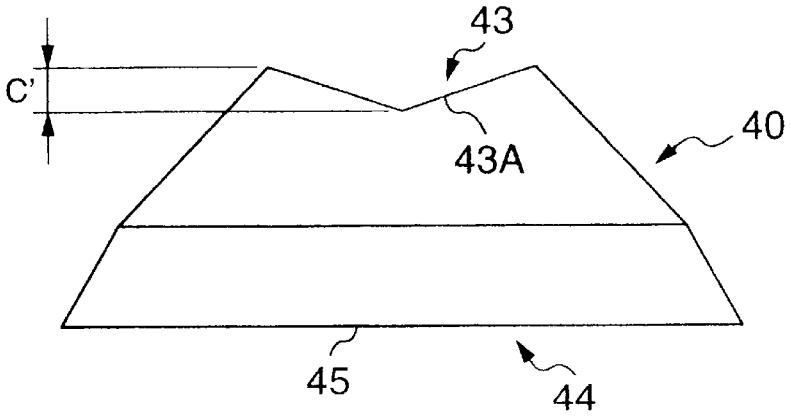
FIG. 5C (PRIOR ART)

When the frame structure 14 is disposed inside the funnel portion 3, the edge portion of the second opening 21 is fitted to the support frame 6 mounted on the side wall of the panel portion 1 together with the peripheral portion of the shadow mask 5, similarly to the known frame structure 40 (see FIGS. 5A to 5C). In this case, the substantially rectangular first opening 20 of small diameter is located adjacent to the electron gun 12 and the substantially rectangular second opening 21 is located adjacent to the shadow mask 5. Three electron beams 13 emitted from the electron gun 12 are allowed to pass through the inside of the frame structure 14 and strike the fluorescent layer 4 through one of electron beam apertures (not shown) of the shadow mask 5, thereby displaying a required image on the face plate.

The substantially V-shaped notches 20A, 20B formed in the two long side walls 15A, 15B are provided for regulating the path for the electron beam passing through the inside of the frame structure 14, similarly to the known substantially V-shaped notches 43A, 43B (see FIGS. 5A to 5C). The maximum depth c of the substantially V-shaped notches 20A, 20B is so selected as to be smaller than the maximum depth c' of the known substantially V-shaped notches 43A, 43B (see FIG. 5A to 5C).

According to the internal magnetic shield having the above structure, when forming the creased lines 19A, 19B, 19C, 19D, the ends thereof adjacent to the first opening 20 are made to coincide respectively with the corresponding corners $\mathbf{20}_1$ to $\mathbf{20}_4$ of the first opening 20, while the ends of the imaginary line extensions thereof adjacent to the second opening 21 are so selected as to be located on the projected plane at the points $\mathbf{21}_{11}$, $\mathbf{21}_{21}$, $\mathbf{21}_{31}$, $\mathbf{21}_{41}$ shifted by the predetermined length Δl from the corresponding corners $\mathbf{21}_1$ to $\mathbf{21}_4$ of the second opening 21 in the direction of long side, respectively. Therefore, in comparison with the known internal magnetic shield (see FIGS. 5A to 5C), as seen from FIGS. 2B and 5B, the effective area of the two long side walls 15A, 15B, through which the terrestrial magnetism passes, is reduced and the effective area of the two short side walls 17A, 17B is increased. In this case, by suitably selecting the predetermined length Δl, that is, the points $\mathbf{21}_{11}$, $\mathbf{21}_{21}$, $\mathbf{21}_{31}$, $\mathbf{21}_{41}$ at which the ends of the imaginary line extensions of the creased lines 19A, 19B, 19C, 19D adjacent to the second opening 21 are located, the ratio of the effective area of the two long side walls 15A, 15B to the effective area of the two short side walls 17A, 17B can be adjusted. This makes it possible to appropriately regulate the three electron beam paths passing through the inside of the internal magnetic shield without adjusting the maximum depth c of the substantially V-shaped notches 20A, 20B. For example, when the predetermined length Δl by which the ends of the imaginary line extensions are shifted from the corners $\mathbf{21}_1$ to $\mathbf{21}_4$ in the direction of long side is 18.7 mm, the maximum depth of the substantially V-shaped notches 20A, 20B is 44.7 mm. These numerical values, however, are just examples and, needless to say, impose no restrictions on the structure of this embodiment.

Figure 3:
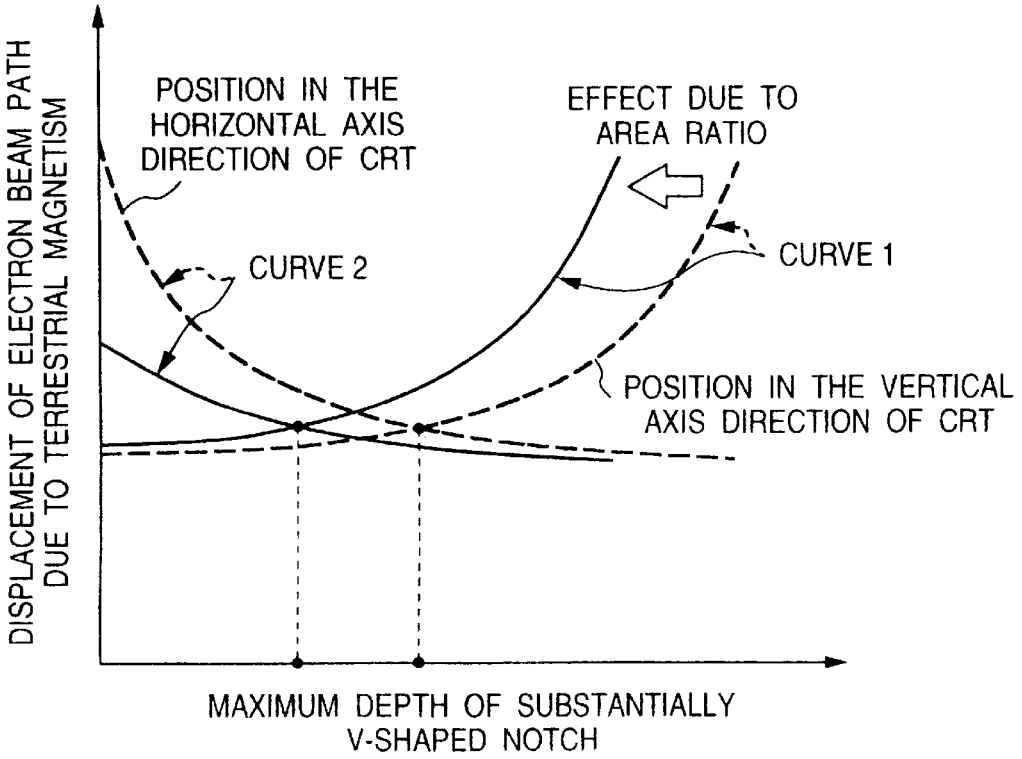
FIG. 3 is a characteristic figure showing the relationship between maximum depth of a substantially V-shaped notch and displacement of an electron beam path.

FIG. 3 is a characteristic figure showing the relationship between the maximum depth of the substantially V-shaped notch and the displacement of the electron beam path due to terrestrial magnetism, which characteristics are obtained when the color cathode-ray tube is so placed that the center axis thereof lies north and south.

In FIG. 3, solid lines show the characteristics obtained by the color cathode-ray tube of this embodiment and broken lines show the characteristics obtained by the known color cathode-ray tube. For both solid and broken lines, a curve 1 shows the characteristics of the color cathode-ray tube in the vertical axis direction (vertical direction, that is, minor axis direction) and a curve 2 show the characteristics of the color cathode-ray tube in the horizontal axis direction (horizontal direction, that is, major axis direction).

As is obvious from the characteristic view of FIG. 3, in the known color cathode-ray tube, displacements of electron beam in the vertical axis and horizontal axis directions cannot be made almost equal unless the maximum depth c' of the substantially V-shaped notches is increased to a certain extent, while in the color cathode-ray tube of this embodiment, displacements of electron beam in the vertical axis and horizontal axis directions can be almost equalized without increasing the maximum depth c of the substantially V-shaped notches so much. Therefore, the color cathode-ray tube of this embodiment proves to be more excellent in total shielding effect because the maximum depth c of the substantially V-shaped notches must not be increased.

Figure 4A:
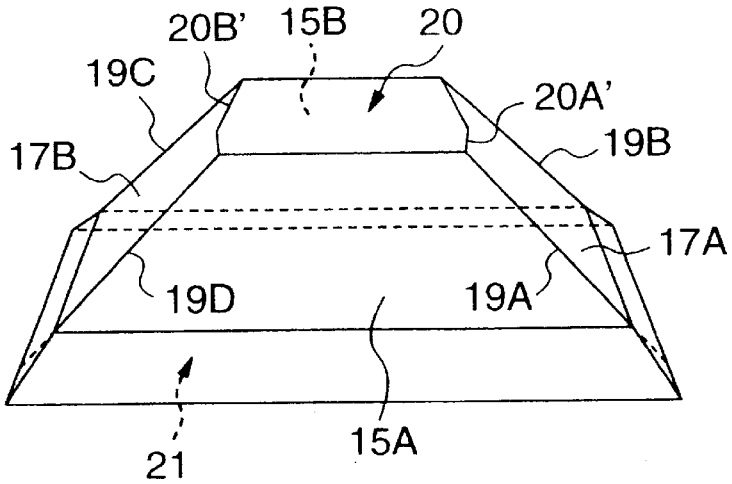
FIGS. 4A to 4C show the structure of a second embodiment of the present invention in which substantially V-shaped notches are formed in short side walls, FIGS. 4A to 4C corresponding to FIGS. 2A to 2C, respectively.
Figure 4B:
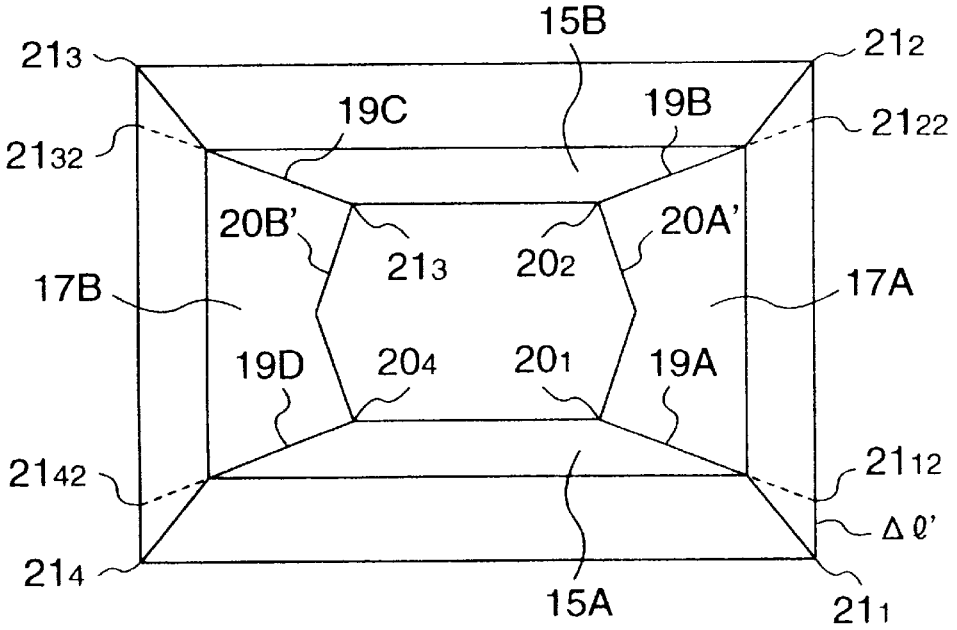
Figure 4C:
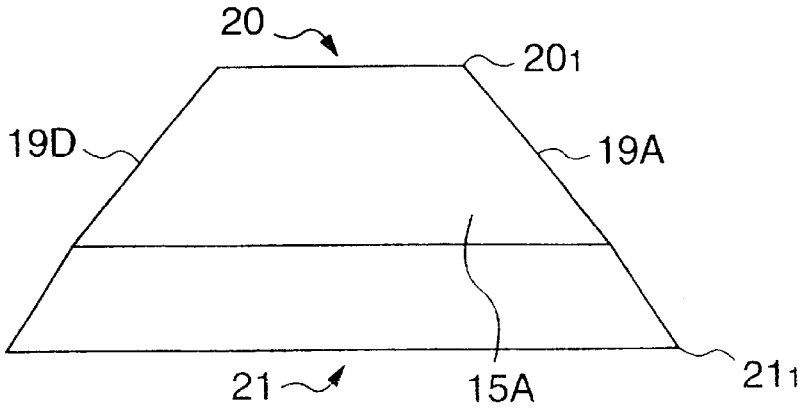

In the present embodiment, t he internal magnetic shield has been described by taking a case that the ends of the imaginary line extensions of the creased lines 19A, 19B, 19c, 19D are so selected as to be located at the points $\mathbf{21}_{11}$, $\mathbf{21}_{21}$, $\mathbf{21}_{31}$, $\mathbf{21}_{41}$ shifted by the predetermined length Δl from the corresponding corners $\mathbf{21}_1$ to $\mathbf{21}_4$ of the second opening 21 in the direction of long side, respectively, and the substantially V-shaped notches 20*a*, 20B are formed in the two long side walls 15A, 15B, respectively. However, the internal magnetic shield according to the present invention is not limited to that having the above structure. As shown in FIGS. 4A to 4C, it is possible according to a second embodiment to change the structure in such a manner that the ends of the imaginary line extensions of the creased lines 19A, 19B, 19C, 19D are so selected as to be located at points $\mathbf{21}_{12}$, $\mathbf{21}_{22}$, $\mathbf{21}_{32}$, $\mathbf{21}_{42}$ shifted by a predetermined length Δl' from the corresponding corners $\mathbf{21}_1$ to $\mathbf{21}_4$ of the second opening 21 in the direction of short side, respectively, and substantially V-shaped notches 20A, 20B are formed in the two short side walls 17A, 17B, respectively.

In the second embodiment as well, by suitably selecting the points $\mathbf{21}_{12}$, $\mathbf{21}_{22}$, $\mathbf{21}_{32}$, $\mathbf{21}_{42}$ at which the ends of the imaginary line extensions of the creased lines 19A, 19B, 19C, 19D adjacent to the second opening 21 are located on a projected plane parallel to the second opening 21, the ratio of the effective area of the two long side walls 15A, 15B to the effective area of the two short side walls 17A, 17B can be adjusted. This makes it possible to appropriately regulate the three electron beam paths passing through the inside of the internal magnetic shield without adjusting the maximum depth of the substantially V-shaped notches.

The first embodiment is suitable for use in the color cathode-ray tube of the type that the fluorescent layer 4 is made of phosphor dots, while the second embodiment is suitable for use in the color cathode-ray tube of the type that the fluorescent layer 4 is made of phosphor stripes.

According to the above embodiments, in order to adjust the ratio of the effective area of the two long side walls 15A, 15B to the effective area of the two short side walls 17A, 17B, the ends of the imaginary line extensions of the creased lines 19A to 19D adjacent to the second opening 21 are so selected as to be located at the points $\mathbf{21}_{11}$ to $\mathbf{21}_{41}$ ($\mathbf{21}_{12}$ to $\mathbf{21}_{42}$) shifted by the predetermined length Δl (Δl') from the corresponding corners $\mathbf{21}_1$ to $\mathbf{21}_4$ in the direction of side without adjusting the maximum depth c of the substantially V-shaped notches. Therefore, it is possible to appropriately regulate the electron beam path without deteriorating the overall shielding effect.

In the above embodiments, the internal magnetic shield has been described as being formed with V-shaped notches in the side faces. However, even in a shield with no notches, direction of the displacement of electron beam attributed to the terrestrial magnetism, which has been adjusted by forming notches, can be adjusted by making use of the structure of the present invention.

As has been described above, according to the present invention, the virtual mean ends of the creased lines adjacent to the second opening are located on a projected plane parallel to the second opening at the points shifted by the predetermined length from the corners in the direction of side for the purpose that the ratio of the effective area of the two long side walls to the effective area of the two short side walls is adjusted by selecting the predetermined length instead of the known means of adjusting the maximum depth of the substantially V-shaped notches formed in the two long side walls or two short side walls. Accordingly, even if the maximum depth of the substantially V-shaped notches is made small, it is possible to appropriately regulate the electron beam path, and moreover the overall shielding effect is not deteriorated.

What is claimed is:

1. A color cathode-ray tube comprising a panel portion, a neck portion and a funnel portion connecting said two portions and having an internal magnetic shield, said color cathode-ray tube comprising at least a fluorescent layer formed on an inner surface of a face plate of said panel portion, a shadow mask disposed opposite to said fluorescent layer, an electron gun housed in said neck portion, and the internal magnetic shield disposed in said funnel portion and made of a substantially quadrangular pyramid-shaped frame structure which has a substantially rectangular first opening of small diameter at one end adjacent to said electron gun and a substantially rectangular second opening of large diameter at the other end adjacent to said shadow mask and creased lines formed between corresponding corners of said first and second openings, wherein each of the creased lines of said internal magnetic shield is formed in such a manner that an end of an imaginary line extension of said creased line adjacent to said second opening is located on a projected plane parallel to the second opening at a point shifted by a predetermined length from the corresponding corner of said second opening in the direction of a side of the second opening, and a segment is made by connecting a predetermined point on a line connecting between said end of the imaginary line extension and the corresponding corner of the first opening to the corresponding corner of the second opening so as to form a part of the creased line adjacent to the second opening, thereby adjusting an area ratio of side faces of the internal magnetic shield.

2. A color cathode-ray tube according to claim 1, wherein the ends of the imaginary line extensions of the creased lines adjacent to said second opening are located on the projected plane at the points shifted by a predetermined length from the corners in the direction of a long side when said fluorescent layer is made of a large number of phosphor dots.

3. A color cathode-ray tube according to claim 2, wherein the side faces of said internal magnetic shield opposite to each other are formed with substantially V-shaped notches in the portions thereof adjacent to said first opening so as to regulate an electron beam path passing through the inside of said shield.

4. A color cathode-ray tube according to claim 1, wherein the ends of the imaginary line extensions of the creased lines adjacent to said second opening are located on the projected plane at the points shifted by a predetermined length from the corners in the direction of a short side when said fluorescent layer is made of a large number of phosphor stripes.

5. A color cathode-ray tube according to claim 4, wherein the side faces of said internal magnetic shield opposite to each other are formed with substantially V-shaped notches in the portions thereof adjacent to said first opening so as to regulate an electron beam path passing through the inside of said shield.

6. A color cathode-ray tube according to claim 1, wherein the side faces of said internal magnetic shield opposite to each other are formed with substantially V-shaped notches in the portions thereof adjacent to said first opening so as to regulate an electron beam path passing through the inside of said shield.

7. A color cathode-ray tube according to claim 1, wherein said substantially quadrangular pyramid-shape frame structure includes two long side walls having edges adjacent said first opening and two long adjustment side walls connected respectively to portions of said two long side walls, said two long adjustment side walls having edges adjacent said second opening, two short side walls having edges adjacent said first opening and two short adjustment side walls connected respectively to portions of said two short side walls, said two short adjustment side walls having edges adjacent said second opening, one of a side surface of a respective one of said two long side walls and the connected said two long adjustment side walls and a respective one of said two short side walls and the connected said two short adjustment side walls extending in substantially a single plane, each of said creased lines of said internal magnetic shield including a creased line extending from the corresponding corner of said first opening along an adjacent long side wall and a short side wall, with the imaginary line extension thereof ending at said second opening along the one of said long and short adjustment side walls which lies in substantially the single plane as the one of said long side wall and said short side wall connected therewith.

8. A color cathode-ray tube according to claim 7, wherein a respective one of said long side walls and said long adjustment side walls connected therewith lie in substantially the single plane.

9. A color cathode-ray tube according to claim 7, wherein a respective one of said short side walls and said short adjustment side walls connected therewith lie in substantially the same plane.

* * * * *